United States Patent [19]

Perrenoud

[11] Patent Number: 4,563,554

[45] Date of Patent: Jan. 7, 1986

[54] HIGH-VOLTAGE SWITCH

[75] Inventor: Blaise Perrenoud, La Neuveville, Switzerland

[73] Assignee: BBC Brown, Boveri & Company, Switzerland

[21] Appl. No.: 589,643

[22] Filed: Mar. 14, 1984

[30] Foreign Application Priority Data

Mar. 28, 1983 [CH] Switzerland ..... 1689/83

[51] Int. Cl.[4] ..... H01H 31/00

[52] U.S. Cl. ..... 200/48 R; 200/163; 74/105

[58] Field of Search ..... 200/48 R, 163; 74/105, 74/106

[56] References Cited

U.S. PATENT DOCUMENTS 3,350,519 10/1967 Badey et al. ..... 200/48 R
3,508,178 4/1970 Chabala et al. ..... 200/48 R
3,553,397 1/1971 Schmitz ..... 200/48 R

FOREIGN PATENT DOCUMENTS 1065150 9/1959 Fed. Rep. of Germany ..... 74/105

*Primary Examiner*—Stephen Marcus
*Assistant Examiner*—Renee S. Kidorf
*Attorney, Agent, or Firm*—Ostrolenk, Faber, Gerb & Soffen

[57] ABSTRACT

A high-voltage switch having a housing supported on a pin insulator and two movable switching pieces mounted in the housing. The movable switch pieces of the switch are coupled via actuating parts to a drive transmission element, a crankshaft, for example, which is guided through the pin insulator to a drive mechanism. The drive mechanism includes the crankshaft which is rotated by one crank whose movement is controlled by another crank. The movable switch pieces are very heavy and must be moved back and forth between ON and OFF switch positions. The drive mechanism provides two precisely located stable positions corresponding to the ON and OFF switch conditions and the heavy switch components are moved such that their motion is damped as they approach one or the other stable position whereby the need for additional damping means for arresting the movement of the switch is avoided. The switch is suitable as a multiphase generator switch having several switch poles.

10 Claims, 8 Drawing Figures

FIG. 2
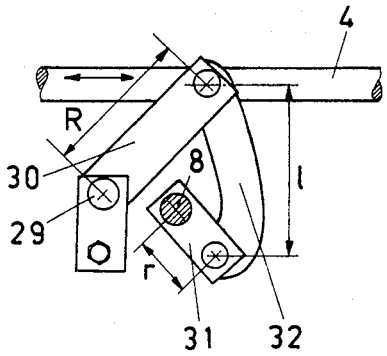
FIG. 3
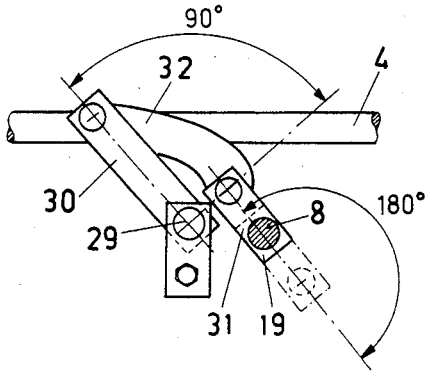
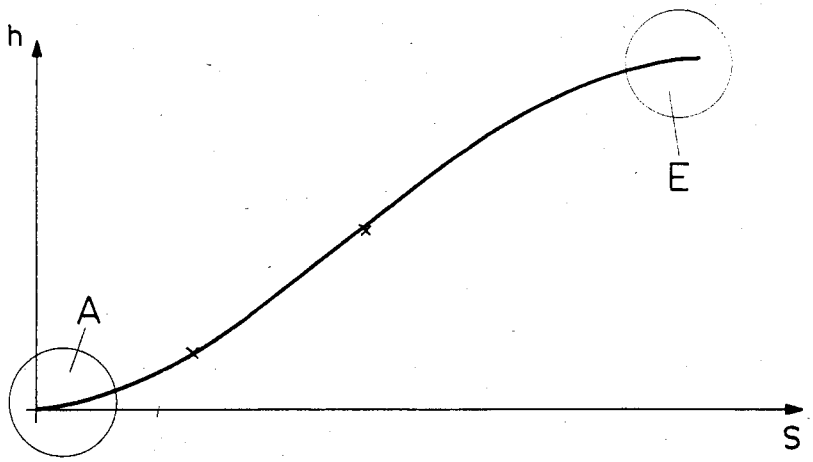
FIG. 4

HIGH-VOLTAGE SWITCH

BACKGROUND OF THE INVENTION

The invention relates to a high-voltage switch and, more particularly, to a crankshaft-type drive transmission for the switch.

A high-voltage switch is known, for example, from German Offenlegungsschrift No. 29 22 913. The known switch includes two switching devices which are located on a head housing and which are attached to it in an electrically insulated manner. The switching devices include movable switch pieces to which are articulated actuating elements. The actuating members are guided from an ON to an OFF position or vice versa via deflecting levers which are driven by a drive element which, in turn, is guided in a pin insulator and rotated by a pneumatic or hydraulic drive. Since the movement between the two end positions corresponding to ON and OFF conditions of the switch occurs rapidly and since considerable masses are moved, special means are ordinarily required to damp the motion of the switching devices before the end location is reached. The type and magnitude of required damping forces are affected by the current and voltage rating of the switch.

SUMMARY OF THE INVENTION

It is an object of the invention to provide a switch of the type described above, in which special damping means are unnecessary and which assures rapid and reliable transmission of the drive forces from the penumatic or hydraulic drive to the switching devices.

The objects of the invention are achieved by means of a crankshaft-type drive transmission which provides both rapid and delay-free transmission of the drive forces to the movable switch pieces, and further has, two extremely stable, dead-center like, locations corresponding to the ON and OFF positions of the switch. Moreover, the switch does not require additional damping means. The drive elements are arranged and designed to ensure that the movable switch pieces are accelerated during a first phase of the switching operation and that their motion is damped shortly before the switch pieces reach their end positions.

BRIEF DESCRIPTION OF THE DRAWINGS

The invention is explained in greater detail below with reference to a preferred embodiment illustrated in the drawing in which:

FIG. 2 is a plan view of a section taken along the line II—II of FIG. 1, in which the drive element designed as a crankshaft is in a first stable location (ON position).

FIG. 3 is a plan view of a section taken along the line II—II of FIG. 1, in which the crankshaft, rotated 180°, is in a second stable location (OFF position).

FIG. 4 is a plot of the stroke h of the movable switch pieces of the high-voltage switch of FIG. 1 as a function of the cylinder stroke s of a pneumatic or hydraulic drive acting on the switch pieces via the crankshaft.

DETAILED DESCRIPTION OF A PREFERRED EMBODIMENT

Figure 1:
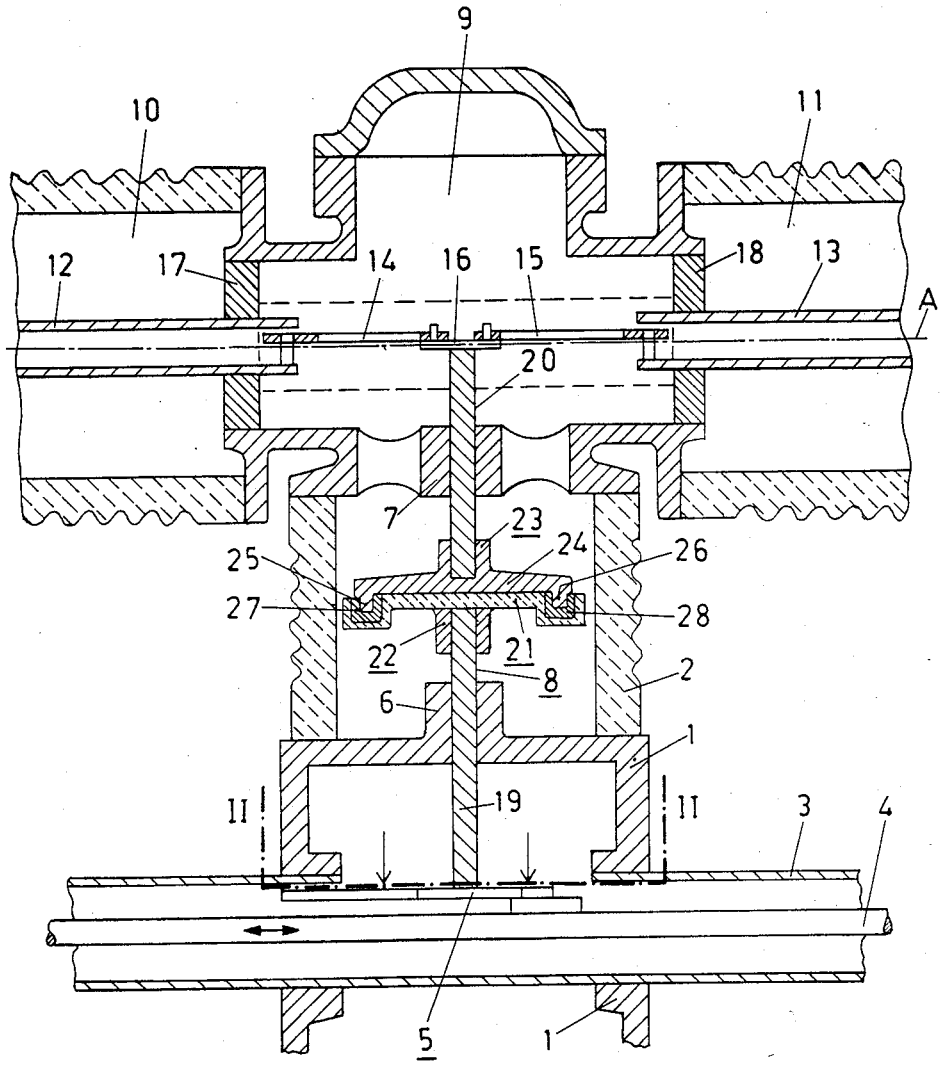
FIG. 1 is a plan view of a section through a high-voltage switch embodiment according to the invention.
Figure 5:
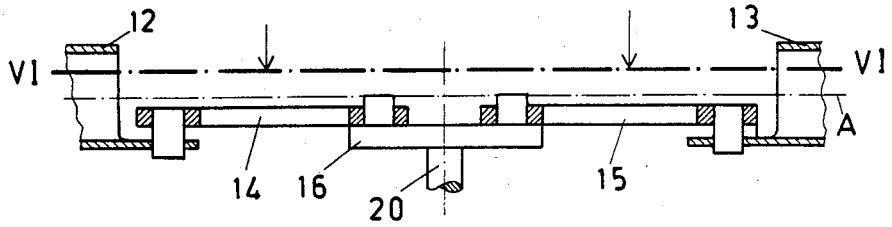
FIG. 5 is an enlarged view of the region delimited by the dashed lines in FIG. 1, in which the crankshaft is in the first stable position.
Figure 6:
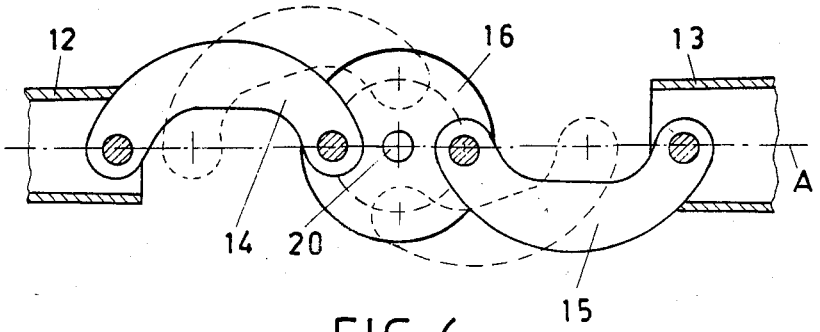
FIG. 6 shows a plan view of a section taken along VI—VI of FIG. 5.
Figure 7:
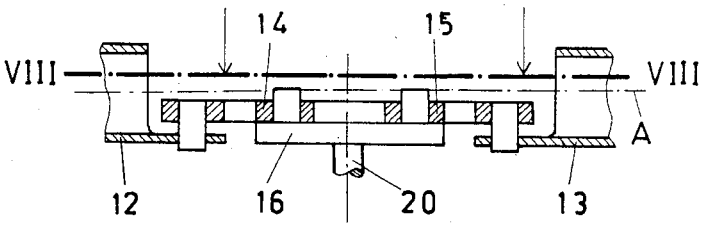
FIG. 7 is an enlarged view of the region delimited by the dashed lines in FIG. 1, in which the crankshaft is in the second stable position.
Figure 8:
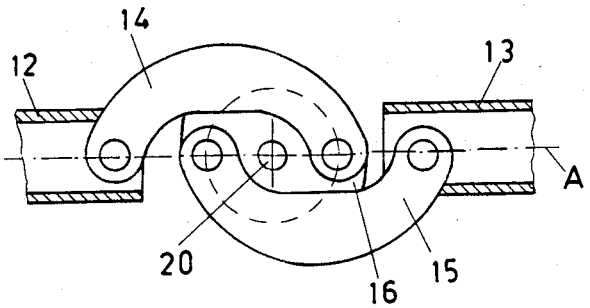
FIG. 8 is a plan view of a section taken along VIII—VIII of FIG. 7.

The high-voltage switch illustrated in FIG. 1 includes a pin insulator 2 fastened to a grounded metal supporting body 1. The pin insulator 2 is of porcelain or a glass-fiber-reinforced plastic. The switch further includes a housing 3 held by the supporting body 1 and including a connecting rod 4 of a pneumatic or hydraulic drive (not shown). A crank mechanism 5 interacts with the connecting rod 4. A crankshaft 8 rotatably supported by bearings 6 and 7 and part of the crank mechanism 5 is guided through the supporting body 1 and the pin insulator 2 into a metal head housing 9.

Attached to the head housing 9 are two switch devices 10 and 11 which are surrounded by insulators (not identified). Each switch device includes a respective movable switch piece 12, 13. The switch pieces 12 and 13 are spaced from one another and extend along a common axis A. The movable switch pieces 12 and 13 can be moved along the common axis by articulated connecting links 14, 15. The connecting links 14, 15 themselves are articulated to a disk 16 connected to the crankshaft 8. The movable switch pieces 12, 13 are guided to slide in bearings 17, 18 serving as a current supply and interact with fixed switch contacts (not shown). The switch devices 10, 11, head housing 9 and pin insulator 2 form a pressure-tight chamber which are filled with an insulating fluid such as, for example, sulfur hexafluoride. However, the entire arrangement can also be housed in an outer housing also filled with an insulating agent.

The crankshaft 8 comprises two crankshaft parts 19 and 20. The lower crankshaft 19 is articulated to the crank mechanism 5 and the upper crankshaft is connected to the disk 16. The ends of the crankshaft parts which face one another are mounted in fittings 22, 23, which are attached respectively to the underside and topside of an insulating-material plate 21, consisting of glass-fiber-reinforced plastic. The fittings 22, 23 each have a two-armed metal support resting against the insulating-material plate 21. As shown in FIG. 1, the metal support of the fitting 23 of the upper crankshaft 20 is provided at its ends with pegs 25, 26 on its side facing the insulating-material plate 21. The pegs 25, 26 engage metal bushes 27, 28 which, in turn, are mounted diametrically opposite one another, in recesses formed in the insulating-material plate 21 in the edge region of the latter. The support fitting 22 of the lower crankshaft 19 has a corresponding support design and likewise engages by means of respective pegs, metal bushes which, in contrast to the metal bushes 27, 28 provided for fixing the upper support 24, are recessed in the underside of the insulating-material plate 21. The metal bushes are arranged diametrically opposite one another in such a way that the two imaginary lines that connect each of the two-armed supports of the upper and lower fittings 22, 23 extend perpendicularly to one another. The two two-armed supports by which the crankshafts 19 and 20 are coupled to the insulating-material plate 21, permit the switch according to the present invention to achieve high force transmission free of play, free of torsion, and with low inertia. The switch can be easily assembled.

For example, the crankshaft 8 is assembled by attaching the insulating-material plate 21 onto the lower part crankshaft 19 and by attaching the upper part crankshaft 20 onto the insulating-material plate 21. The high electrical voltage between the crank mechanism 5 which lie at ground potential and the head housing 9 which is exposed to high-voltage is blocked by the insulating-material plate 21. Moreover, because the supports are cross-shaped, the creep distance between the parts of the fittings 22 and 23 which are at high-voltage potential and those which are at ground potential is increased.

The design of the crank mechanism 5 driving the crankshaft 8 is apparent from FIGS. 2 and 3. The crank mechanism 5 has a crank arm 30 which is rotatable about a fixed axle 29. The end of the arm 30 which is not in contact with the axle 29, is rotatably or hingedly connected to the connecting rod 4 of the pneumatic or hydraulic drive (not shown) and to a connecting link 32 articulated to a crank arm 31 which drives the crankshaft 8. The radii R and r of the arcs described by the cranks arms 30 and 31, the effective length 1 of the angled connecting link 32, and the distance between the axles 29 and 8 of the crank arms 30 and 31 are selected by appropriate calculations, such that the crank arm 31 executes a rotation of 180° when the crank 30 passes from a first preferred position, which forms an acute angle with the connecting link 4, to a second preferred position, which forms an obtuse angle with the connecting rod 4. This movement causes the crank 30 to undergo a rotation of approximately 90°. As shown in FIGS. 2 and 3, the crank 30 and the link 32 are hinged to the rod 4 by a pin which passes through the crank 30, link 32 and rod 4. It is readily apparent, therefore, that the rod 4 moves back and forth in the direction of the arrow of FIG. 2 and also up and down with respect to the plane of the figure.

Such an arrangement and movement of the crank mechanism 5 are advantageous in that the angular speed of the crankshaft 8 and consequently the speed at which the movable switch pieces 12 and 13 move between the two stable end positions corresponding to the ON position (FIG. 2) and OFF position (FIG. 3) is increased considerably. Yet, two highly stable dead-center locations are also provided for the ON and OFF positions.

This characteristic is shown, for example, in FIG. 4 is which the stroke s of the pneumatically or hydraulically driven switch-drive piston coupled to the connecting rod 4 is plotted as a function of the stroke h of the movable switch pieces. It is evident that in the ON position E and in the OFF position A the drive has two definite stable locations in which, even when the stroke s of the hydraulic or pneumatic drive is considerable, only a relatively slight stroke h of the movable switch pieces 12 and 13 occurs. On the other hand, the two switch pieces 12 and 13 move rapidly when they are located away from and between the two ON and OFF locations. Furthermore, FIG. 4 shows that the movement of the switch pieces 12 and 13 is also damped sharply before they reach their end locations. This is highly advantageous especially in high-voltage switches with large moving masses, such as generator switches.

As shown in FIGS. 5 to 8, the drive force is transmitted from the crankshaft 8 to the movable switch pieces 12 and 13 via a disk 16 which is attached to the upper crankshaft 20. To the disk 16 are eccentrically connected connecting links 14 and 15 which are fastened through respective hinges or pins to the movable switch pieces 12 and 13, respectively.

In the ON position, (FIG. 5 and FIG. 6), the two connecting links 14 and 15 are offset relative to one another in the direction of the common axis A. In the OFF position, the crankshaft 8 and the disk 16 are rotated in a clockwise direction. The connecting links 14 and 15 assume the first position shown by the broken lines in FIG. 6 and then end at the positions illustrated in FIGS. 7 and 8. Because they are bent or angled in opposite directions, the two connecting links 14 and 15 can travel past one another without impedance and can assume the dead-center location of the OFF position.

The foregoing high-voltage switch is preferably a switch capable of handling nominal currents of the order of than 8kA, at nominal voltages of more than 24kV, such as are encountered, for example, in a generator switch. Although only one switch pole has been illustrated and described in the preferred embodiment, it is easily possible to switch other switch poles by means of the same hydraulic or pneumatic drive. All that is necessary is to extend the connecting rod 4 further to the next switch pole which is designed and driven in the same way as described in the preferred embodiment.

A multi-pole high-voltage switch in accordance with the invention also has the advantage, as compared to known multi-pole switches, that because of the definite stable locations of each pole, the end locations are reached precisely at the same time. Therefore, for example in a three-phase switch, using three switch poles, all three phases are switched ON and OFF at the same time. This feature is present even when production tolerance variations between different drive transmission elements are relatively large.

I claim:

1. A high voltage switch comprising:

a pin insulator having a top and a bottom and a switch housing located atop said pin insulator;

two movable switch contact pieces movably supported in said housing, each movable switch contact piece being movable between a respective pair of first and second stable positions;

switch driving means located below said pin insulator;

a rotatable crankshaft extending between said switch housing and said driving means and through said pin insulator for moving said switch contact pieces, generally linearly, back and forth between said respective first and second stable positions, said crankshaft having a first end located at said housing and a second opposite end adjacent said switch driving means;

means for coupling said first end of said crankshaft to said movable contact pieces; and crank means for interconnecting said second end of said crankshaft to said switch driving means and for rotating said crankshaft, said crank means being actuated by said driving means and further including means for controlling the angular movement of said crankshaft such that a lower change in the position of said switch contact pieces is caused by a predetermined unit change in the position of said driving means when said pieces are moving adjacent to said respective first and second stable positions as compared to when said pieces are further from said respective stable positions.

2. The switch of claim 1, further comprising means for causing said crankshaft to assume first and second stable angular positions corresponding to said first and second stable positions of said two movable switch contact pieces.

3. The switch of claim 2, in which said switch driving means comprises a connecting rod and in which said crank means comprises:

a first crank arm rotatable about a fixed axle and hingedly connected to said connecting rod;

a second crank arm connected to and adapted to rotate said crankshaft; and a first connecting link, connected at an end thereof to said second arm and, at another opposite end thereof, to said connecting rod and to said first crank arm, said first crank arm being operative to cause said connecting rod to be movable along a predetermined path, said second crank arm and said first connecting link being operative to rotate said crankshaft when said connecting rod is caused to move over said path, said second arm and said first connecting link being so located with respect to said first crank arm and said connecting rod to obtain said controlled angular movement of said crankshaft.

4. The switch of claim 3, in which said means for coupling said first end of said crankshaft comprises a disk connected to said first end of said crankshaft and second and third connecting links connected to said disk and, respectively, to one and the other of said two movable switch contact pieces, each one of said second and third connecting links having an elongate, arcuate body and being pivotably connected to said disk and to its respective movable contact piece so that said piece is movable between said first and second stable positions in response to rotation of said disk.

5. The switch of claim 4, in which a set of parameters associated with said crank means which includes, a cranking radius R of said first crank, a cranking radius R of said second crank, the length of said first connecting link, and the distance between said fixed axle and said crankshaft are selected to cause said crankshaft to rotate through approximately 180° when said first crank moves through an angular displacement having a beginning position at which said first crank arm forms an acute angle with said connecting rod and an end position at which said first crank arm forms an obtuse angle with said connecting rod.

6. The switch of claim 3, in which a set of parameters associated with said crank means which includes, a cranking radius R of said first crank, a cranking radius r of said second crank, the length of said first connecting link, and the distance between said fixed axle and said crankshaft are selected to cause said crankshaft to rotate through approximately 180° when said first crank moves through an angular displacement having a beginning position at which said first crank arm forms an acute angle with said connecting rod and an end position at which said first crank arm forms an obtuse angle with said connecting rod.

7. The switch of claim 6, in which said second and third arcuate connecting links are arranged to curve away from one another to permit said disk to rotate through at least an angle of 180°.

8. A switch as in any of claims 1 through 7, wherein said crankshaft comprises first and second crankshaft sections which are coupled to one another through an insulating-material plate located in said pin insulator.

9. A switch as in claim 8, wherein said insulating material plate comprises a topside and an underside and a respective pair of diametrically displaced metal bushes located on each said side of said plate for engaging respectively said first and second shaft sections of said crankshaft.

10. The switch as in claim 1, wherein said movable switch pieces are movable along an imaginery straight line which passes through said switch housing, said line extending generally perpendicularly to the axis of rotation of said crankshaft.

* * * * *